US007819518B2

(12) United States Patent
Rimai et al.

(10) Patent No.: US 7,819,518 B2
(45) Date of Patent: Oct. 26, 2010

(54) DIGITAL PRINTING APPARATUS FOR PRODUCING PRINTS AT HIGH SPEED

(75) Inventors: Donald S. Rimai, Webster, NY (US); Thomas N. Tombs, Webster, NY (US); Robert E. Zeman, Webster, NY (US); Michael T. Regan, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 414 days.

(21) Appl. No.: 11/445,712

(22) Filed: Jun. 2, 2006

(65) Prior Publication Data

US 2007/0279472 A1 Dec. 6, 2007

(51) Int. Cl.
*B41J 2/01* (2006.01)

(52) U.S. Cl. ..... 347/103; 347/102

(58) Field of Classification Search ..... 347/101–103
See application file for complete search history.

(56) References Cited

U.S. PATENT DOCUMENTS

2002/0164177 A1* 11/2002 Watanabe et al. ..... 399/237
2003/0146963 A1* 8/2003 Murray ..... 347/103
2004/0090508 A1 5/2004 Chowdry et al.

FOREIGN PATENT DOCUMENTS

EP 0 530 627 3/1993
EP 0 561 419 9/1993

* cited by examiner

*Primary Examiner*—Stephen D Meier
*Assistant Examiner*—Alexander C Witkowski
(74) *Attorney, Agent, or Firm*—Lawrence P. Kessler; Eugene I. Shkurko

(57) ABSTRACT

A high speed digital printing apparatus having an imaging member, an ink jet head capable of image-wise jetting ink onto the imaging member, a mechanism for fractionating such image-wise ink on the imaging member to remove liquid therefrom, an intermediate transfer member onto which such image-wise ink is transferred from the imaging member, and a transfer member forming a nip with the intermediate transfer member for transferring a liquid-depleted image-wise ink to a receiver. An ink suitable for use in the printing press apparatus is formed by dispersing an ink concentrate with a suitable solvent.

16 Claims, 3 Drawing Sheets

DIGITAL PRINTING APPARATUS FOR PRODUCING PRINTS AT HIGH SPEED

FIELD OF THE INVENTION

This invention relates in general to digital printing, and more particularly to a digital printing apparatus for producing prints at a high speed.

BACKGROUND OF THE INVENTION

In offset printing presses, printed pages are typically produced by first image-wise inking a lithographic imaging plate with an ink of a specific color. The inked image is then transferred through the use of surface forces to an intermediate member. The intermediate member generally includes an elastomeric member. Paper or other suitable receiver materials are then pressed into contact with the intermediate member and the inked image transferred to the receiver. This process is repeated multiple times until the desired number of prints has been obtained and the lithographic plate is then discarded. To produce multicolor images, the press includes a series of stations, each having an inking station containing a chosen color of ink such as an appropriate subtractive primary color. The receiver is transported from station to station, whereby the appropriate color of ink is transferred, in register, to the receiver.

A major disadvantage of offset, or lithographic, printing is that the prints made from that process are not addressable; that is to say that each print must be identical to every other print. In this age of computer technology, the ability of a printer to vary the content of each printed page is of great importance. Another disadvantage is that fabricating the imaging plates is time consuming and expensive. This means that it is generally not cost effective to produce short runs, especially of color images whereby each color requires a separate imaging plate.

Electrophotographic and ink jet engines can be used to print pages digitally. Neither requires that imaging plates be generated. However, each has its limitations. Electrophotographic engines can potentially print color digital images at a rate of approximately 180 A3 sized pages per minute. However, producing wider prints or running at a faster speed becomes problematic because of tolerances that need to be maintained, toner fusing, toner replenishment, etc.

Ink jet technology is also limited in the area of high speed, high volume printing, principally because of the amount of water or solvent that would have to be removed. This would be especially problematic if the printed pages contain significant amounts of image content, as would be the case in which pictures, for example, are being printed or the images contain significant areas of high-density coverage.

In the related art, a system for digitally printing images, particularly color images, that combines features of ink jet and electrophotographic technologies is described. In particular, U.S. Pat. No. 6,767,092, issued on Jul. 27, 2004 in the names of John W. May et al., describes a process in which pigment particles are dispersed as a colloid in either water or an organic solvent. The colloid is image-wise applied to an imaging member and the pigment particles are coagulated and excess liquid is removed via a squeegee, an external blotter device, an evaporation device, a skiving device, or an air knife. The image is then transferred to a receiver, such as paper. Alternatively, the image can first be transferred to an intermediate member and then from the intermediate member to the receiver. When an intermediate member is utilized in a printer capable of printing color images, modules including the primary imaging member are located around the intermediate member and the color separations are transferred in register to the intermediate member. The composite image is then transferred to the receiver.

Pigment coagulation, by itself, may not be totally effective in separating the solvent from the pigment. Moreover, pigment coagulation may result in a loss of image quality as small marking particles within a droplet that uniformly would coat a pixel may coagulate into a larger marking particle that puts a lot of pigment in an uncontrolled portion of a pixel and none in another. Moreover, coagulation does not necessarily fractionate the solvent from the pigment. Upon removal of excess solvent, pigment may also be carried along, further degrading the image.

Another limitation of the technology described in the related art is that it does not allow for the efficient recycling of the effluent. Specifically, fine particulate contaminants such as fibers, calcium carbonate, or clay, for example from the paper receiver can be difficult and slow to filter out of the effluent. If that material winds up back in the ink jet reservoir, it can plug ink jet nozzles.

Another limitation of the technology described in the related art is that, when using a transfer intermediate member, the print engine is capable of printing with more than four colors or, if necessary and desirable, to allow fewer than four colors to be used in a cost-effective manner. Specifically, however, the engine described that utilizes an intermediate transfer member is designed and built to include four printing modules. This design impacts the unit manufacturing cost (UMC), and makes the production costs of such engines relatively insensitive to the inclusion of fewer than four modules.

It is the purpose of this invention to provide the technology to overcome the aforementioned limitations.

SUMMARY OF THE INVENTION

In view of the above, this invention is directed to provide a digital printing press for producing prints at a high speed. The high speed digital printing apparatus includes an imaging member, an ink jet head capable of image-wise jetting ink onto the imaging member, a mechanism for fractionating such image-wise ink on the imaging member to remove liquid therefrom, an intermediate transfer member onto which such image-wise ink is transferred from the imaging member, and a transfer member forming a nip with the intermediate transfer member for transferring a liquid-depleted image-wise ink to a receiver. An ink suitable for use in the printing apparatus is formed by dispersing an ink concentrate with a suitable solvent.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
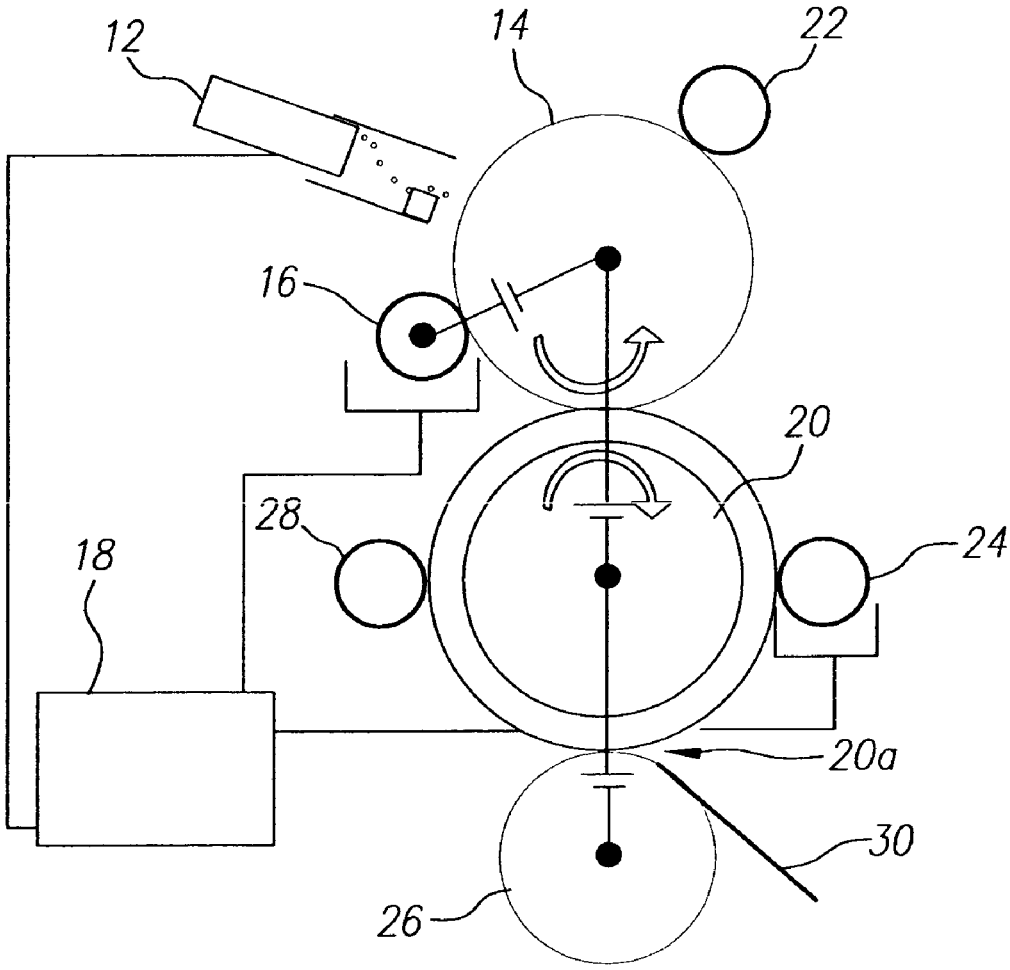
FIG. 1 is a schematic view of a high-speed digital printing apparatus according to this invention.

Referring now to the accompanying drawings, FIG. 1 shows a schematic of the digital printing apparatus engine of this invention. An inking head 12, such as a typical continuous ink jet type (or drop on demand), is provided to deposit drops of ink onto an imaging roller 14 in an image-wise fashion in the manner commonly accomplished with known ink jet technology. The imaging roller 14 is preferably metal but may, if desired by the specific process chosen, be of an alternative material such as a ceramic or polymer.

The ink differs from normal ink jet inks in that normally, ink jet inks include pigments or dyes in a colloidal suspension or solution. The ink used in this invention includes particles where the particles may be marking particles having a colorant such as a dye or pigment in a binder such as a polymer. Suitable polymers include, for example, polyesters, polystyrenes, or polyester acrylates, as are commonly used in electrophotographic toners. The ink may also include suitable charge agents capable of charging the marking particles in a desired manner. The ink would also include a solvent. While water is a suitable solvent in some of the modes of operation of this invention, it is preferable that the solvent be a dielectric liquid such as an organic solvent. A preferred solvent would be Isopar L, although other organic dielectric solvents would also be suitable. It is preferable that the marking particles not be soluble in the solvent. Nonorganic dielectric solvents such as silicone or mineral oils, various alcohols, etc. may also be used.

The particles in the ink need not be marking particles. Rather, they can be identical to the marking particles except that they lack colorant. Such particles can be useful to apply a uniform gloss to the image, protect the image from abrasion, bricking (i.e. having the individual imaged sheets adhere to each other under the influence of heat and/or pressure), or reduce cracking for example. The ink may or may not have a coagulating agent. Alternatively, a coagulating agent may be applied separately if desired through, for example, another ink jet head (not shown). However, coagulation is not a requirement of this invention.

While it is preferable to use as high a concentration of marking particles as possible, current ink jet head technology limits the concentration to less than approximately 10% by weight. The ability to produce a stable colloid would also limit the particle concentration to about this concentration. Reducing the concentration of the marking particles too far may adversely affect the ability to obtain necessary high image densities and can require too much solvent to be applied. The marking particle concentration should not be less than 1% by weight. It is preferable that the marking particle concentration be between 2% and 7% by weight for the jetable ink. The ability to jet the ink also limits the size of the marking particles to less than 3 μm in diameter, and preferably to less than 1 μm in diameter, and more preferably to less than 0.5 μm in diameter. The marking particles can be made by known techniques such as grinding and classifying. However, it is preferable to produce the particles by chemical means, such as emulsion polymerization, evaporative limited coalescence, limited coalescence, or spray drying, for example.

The ink deposited image-wise on the imaging roller 14 is concentrated by fractionating the marking particles from the excess solvent. In the preferred mode of operation, as shown in FIG. 1, fractionation is accomplished using a doctor roller 16, or a similarly acting doctor blade 16. In this preferred mode, the developer ink includes a dielectric solvent and marking (or non-marking) particles, as described above. The marking particles have a predetermined charge, preferably fixed using an appropriate charge agent such as those well known in the literature. A difference of potential is set up between the doctor roller 16 and the metallic or otherwise electrically conducting imaging roller 14. Alternatively, a difference of potential can be set up using a plate or similar structure (not shown) located immediately upstream, in the process direction, from the doctor roller 16. The potential is set to drive the marking particles in the solvent towards the imaging roller 14, thereby allowing the doctor roller or blade to skive the excess solvent off of the imaging roller. In the preferred mode of operation, the effluent is then captured and delivered to a recycler 18 for recycling to the ink reservoir for the inking head 12.

In the preferred mode of operation, the ink image (after fractionation) is transferred to a transfer intermediate roller 20, including an elastomeric blanket. This is done by establishing an electrical bias between the imaging roller 14 and the intermediate roller 20, so as to urge the marking particles to transfer to the intermediate roller 20. After transfer, the imaging roller 14 is cleaned by any suitable cleaning mechanism 22, while the intermediate roller 20 is rotated with a second doctor roller 24, which can, if desired or necessary, further concentrate the ink in the manner similar to that described above. If desired, that is if the effluent is sufficiently clean or can be cleaned to remove contamination, the effluent from the doctor roller 24 can also be recycled through the recycler 18 to the ink reservoir of the inking head 12. If, on the other hand, the effluent has picked up contamination from the paper receiver, it can be discarded. As most of the effluent, in the preferred mode of operation, would be captured in the skiving process on the imaging roller 14, and that material should not be contaminated with debris, the second fractionation step may be optional.

The transferred ink image is thereafter transferred to a receiver 30 by passing the receiver 30 through the nip 20*a* formed by the intermediate transfer roller 20 and a transfer roller 26. The intermediate transfer roller 20 and the transfer roller 26 are electrically biased so as to urge the marking particles from the intermediate transfer roller 20 to the receiver 30. The intermediate transfer roller 20 is then sent through a cleaning mechanism 28, similar to cleaning mechanism 22, to remove residual ink and other contaminants.

In an alternative embodiment, fractionation of the ink can be accomplished using a porous imaging roller 14*a* (see FIG. 4) in place of imaging roller 14.

In this alternate embodiment, the ink is drawn into a porous cylinder 40 of the imaging roller 14*a* by applying a vacuum V to the interior of the porous cylinder. The effluent is then recycled back into the inking reservoir for the inking head 12*a*, if desired. The pores of the porous cylinder 40 are sufficiently small so that the marking particles in the ink are not drawn through the pore structure along with the effluent, but, rather, remain on the surface. In another alternative embodiment, fractionation can be accomplished using an imaging roller 14*b* having an open cell foam structure 50 (see FIG. 5) onto which the ink is deposited. The excess solvent can then be rung from the imaging roller by pressing the foam structure 50, against a pressure roller 52, and the effluent captured and recycled, if so desired. In this embodiment, inks including either an aqueous or dielectric solvent can be used. In the case in which the ink includes a dielectric solvent, the particles in the concentrated ink can be electrostatically transferred to the intermediate transfer member and receiver. When non-dielectric solvents, such as water, are used, the ink needs to be transferred through the use of surface forces by contacting the ink with the receiver, which can be, depending on the specific transfer, either the intermediate transfer roller or the receiver (e.g. paper).

Although ink jet inks are generally self-fixing, fixing of the ink particles on the receiver can be enhanced using appropriate thermal, solvent, or pressure fusing, as is well known in the art of electrophotography.

Figure 2:
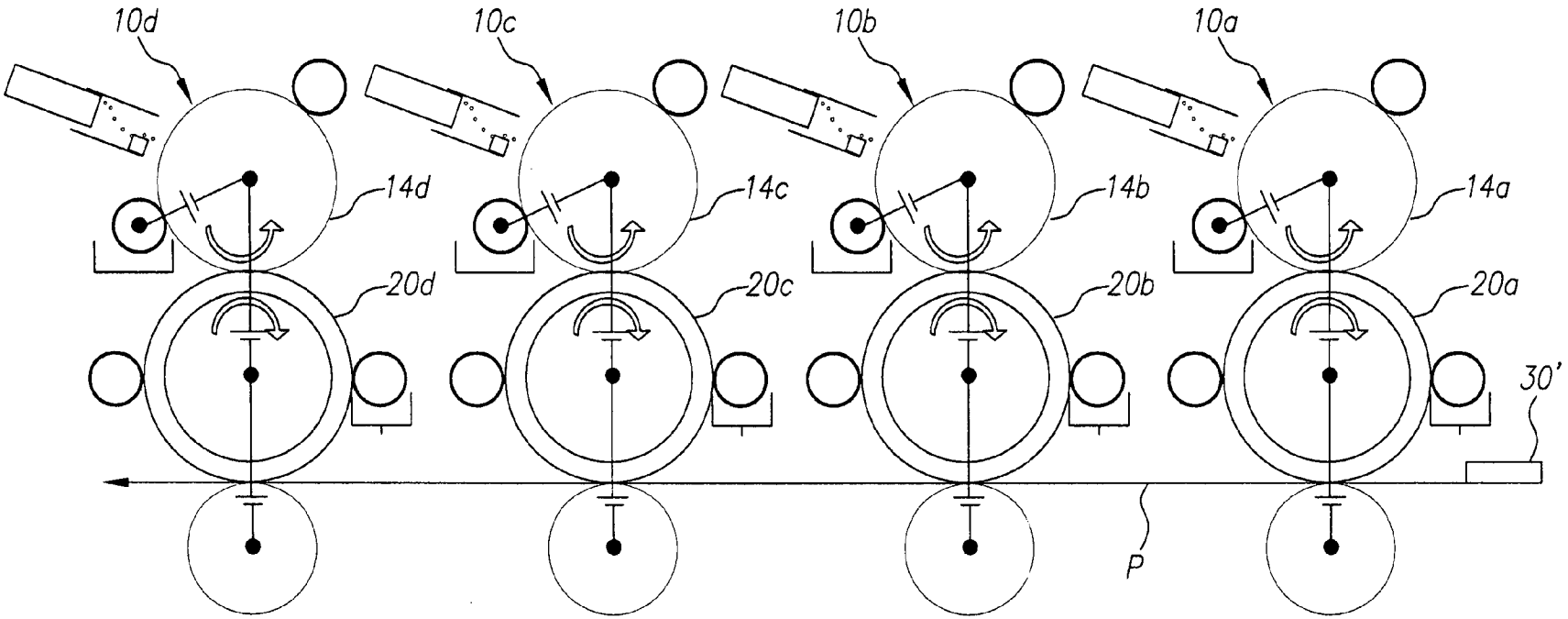
FIG. 2 is a schematic view of a multi-module version of this device.

In order to produce documents with more one color of particle or, equivalently, if it is desired to use an ink, with clear (non-marking) particles, a printing apparatus is provided with a plurality of modules 10*a*-10*d*, such as shown in FIG. 2.

In such a case, each module 10*a*-10*d* deposits a separate color or separation image of marking particles, or equivalently, non-marking particles on respective imaging rollers 14*a*-14*d*. Each separation is then transferred to the intermediate transfer roller 20*a*-20*d* within the respective module 10*a*-10*d*. Each separation is then transferred, in register, to a receiver 30', by transporting the receiver 30' from module to module along path P and subjecting the receiver to appropriate transfer conditions as previously described. The receiver 30' can be transported using known techniques such as a vacuum or electrostatic web transport, or grippers for example. The modules 10*a*-10*d* are driven in synchronization to allow a registered image to be produced by known techniques, such as gearing the modules together, using a drive belt, particularly a toothed drive belt, a frictional drive mechanism, or an encoder and appropriate motor drives, for example. In this manner, a digital printing engine is provided that allows as many separate color or clear inks as desired to be used.

It is also possible to use a single module to print a custom spot color, rather than using a plurality of modules, providing an appropriate color ink that is produced by blending two or more color inks. Similarly, less saturated color inks can be produced by blending certain colors with nonmarking inks within a single station, thereby allowing the other stations to be used for different colors or applications, reducing the number of transfer operations, and improving image quality by reducing artifacts, such as errors in registration.

A particular advantage of this invention is that it enables images, to be created with higher color density than can normally be obtained with conventional ink jet technology. Specifically, conventional ink jet printing deposits approximately 95% by weight of water or other solvent on paper for every 5% by weight of dye or pigment. This high liquid content can saturate a receiver. Moreover, the presence of that much solvent can cause colors to run into one another, resulting in poor color quality, or result in loss of resolution, for example. By separating the marking particles from the solvent prior to deposition on the receiver, as described in this invention, such problems are substantially eliminated. Moreover, the elimination of the large amounts of solvent or water allows more marking particles to be deposited per unit area, thereby allowing higher image densities to be achieved.

Another advantage of this invention is that it enables application of a clear or protective layer over the image. Such layers are often applied in graphic arts to achieve uniform gloss, or protect the image for example. However, because the application of such a clear layer in a conventional ink jet process can cause the colors to run and saturate the receiver, it is not feasible to accomplish this end in conventional ink jet printing apparatus. The elimination of most of the solvent according to this invention allows uncolored marking particles to be deposited over the image, thereby allowing tough overcoats to be deposited. Also, the presence of the clear overcoats allows uniform, controllable gloss levels to be achieved.

In a preferred mode of practicing this invention, the marking (non-marking) particles soften slightly, but not to the point that they significantly dissolve, in the solvent. This facilitates the ability of the ink to be self fixing on the receiver. In another mode of practicing the invention, the marking particles can be permanently fixed by the application of heat and/or pressure, or upon exposure to the vapors of a solvent in which the particles are soluble.

In another preferred mode of practicing this invention, the image is glossed by subjecting the image-bearing receiver, either before or preferably after fusing, to heat and pressure by pressing the image-bearing side of the receiver against a smooth belt or web between a heated nip formed by two or more rollers. One of the rollers is heated to a temperature above the glass transition temperature of the particles. The belt bearing the image-bearing receiver is transported to a point where the image-bearing receiver has cooled to a temperature below the glass transition temperature of the particles, where the image-bearing receiver is separated from the smooth belt or web.

In the practice of this invention, it is preferred to recycle the effluent of the developer. Specifically, the effluent needs to be recycled back into a reservoir that holds the ink for the inking head (e.g. element 12 of FIG. 1). Since the marking particles have been removed from the effluent, it is necessary that the ink be replenished with a marking (non-marking) particle concentrate that can be diluted with the effluent within the apparatus so that, by the time the ink reaches the ink jet head, a jetable ink with a proper concentration of particles has been produced. The concentration level of the ink concentrate should be adjusted so that the amount of solvent in the concentrate closely matches the amount of solvent lost to the system, i.e. the amount of solvent that the process is unable to recycle. Losses can include the amount of solvent that had not been fractionated, and wound up transferring with the marking particles, as well as any solvent lost during purification of the effluent to render it suitable to feed back into the inking system. While it is preferred to introduce the ink concentrate and recycled effluent directly back into the ink reservoir, it may be preferable, under certain circumstances, to blend the effluent with the ink concentrate in a separate reservoir that is located either within or outside the apparatus proper.

Figure 3:
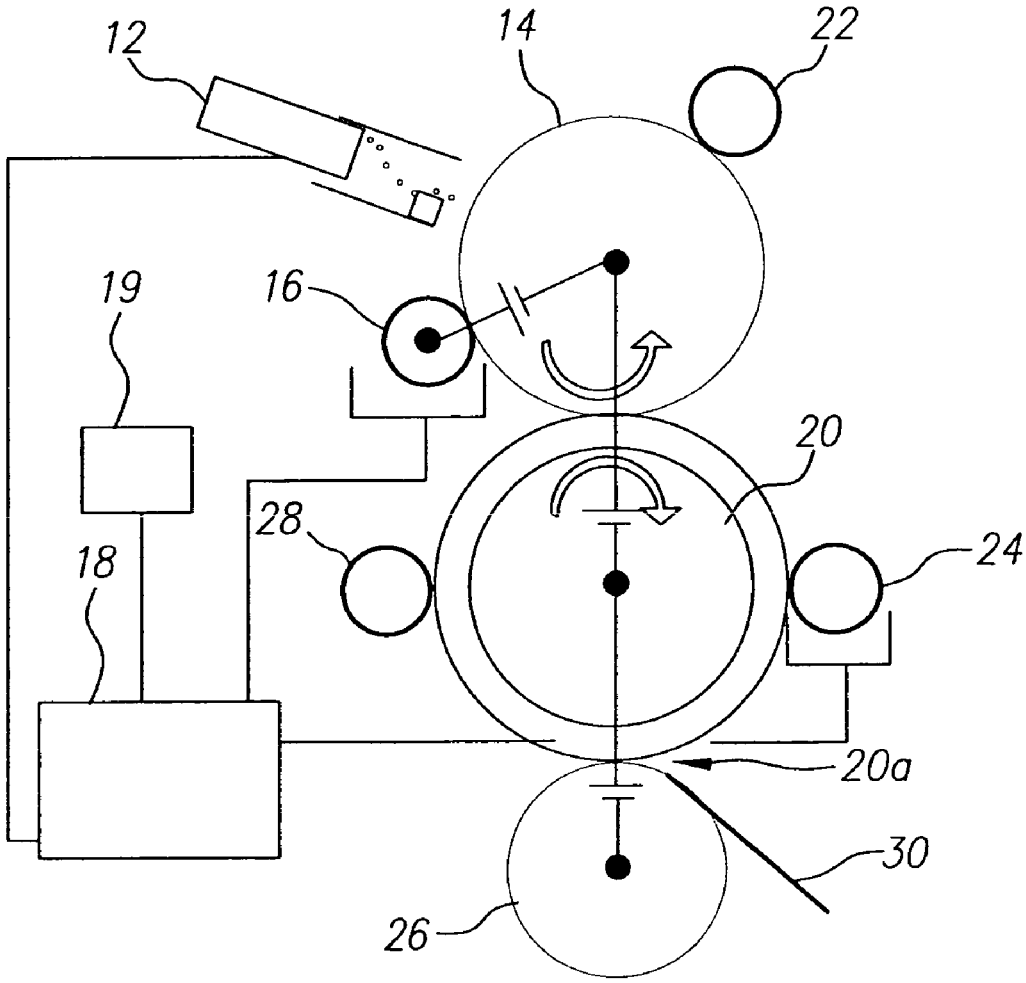
FIG. 3 is a schematic view of an alternate embodiment of a high-speed digital printing apparatus including a device for adding ink concentrate.

FIG. 3 shows a digital printing apparatus according to this invention with device 16 and 24 (as described above with reference to FIG. 1) for collecting the supernatant solvent after fractionation, with such supernatant solvent flowing into recycler 18. Appended to recycler 18 is a container 19 for concentrated ink. Ink from the concentrate is mixed with the effluent to bring the ink up to the appropriate concentration with the ink concentration determined using known means. If desired, the effluent can first be filtered or otherwise purified prior to being collected in the recycler 18.

The invention has been described in detail with particular reference to certain preferred embodiments thereof, but it will be understood that variations and modifications can be effected within the spirit and scope of the invention.

PARTS LIST

10*a*-10*d* Module
12, 12*a* Inking head
14*a*-14*d* Imaging roller
16 Doctor roller
18 Recycler
19 Container
20*a*-20*d* Intermediate transfer roller
22 Cleaning mechanism

24 Doctor roller
26 Transfer roller
28 Cleaning mechanism
30 Receiver
40 Porous cylinder
50 Structure
52 Pressure roller

What is claimed is:

1. A high speed digital printing press comprising:

an imaging member;

an ink jet head capable of image-wise jetting ink onto said imaging member;

a first mechanism for fractionating such image-wise ink on said imaging member to concentrate such image-wise ink and remove liquid therefrom;

an intermediate transfer member, including an elastomeric blanket, onto which such image-wise ink is transferred from said imaging member;

a second mechanism for fractionating such image-wise ink on said intermediate transfer member to concentrate such image-wise ink and remove liquid therefrom; and a transfer member forming a nip with the intermediate transfer member for transferring a liquid-depleted image-wise ink to a receiver.

2. An apparatus according to claim 1 wherein said mechanism for fractionating such image-wise ink on said imaging member has an electrical bias applied between said imaging member and said fractionating member.

3. An apparatus according to claim 2 wherein said mechanism for fractionating such image-wise ink on said imaging member is an electrically biasable skiving member.

4. A apparatus according to claim 1 wherein said imaging member is porous.

5. An apparatus according to claim 1 wherein such image-wise ink on said imaging member is electrostatically transferred from said imaging member to said intermediate transfer member.

6. An apparatus according to claim 1 further including a recycling mechanism for returning removed liquid from said fractionating mechanism to said ink jet head.

7. An apparatus according to claim 1 wherein said digital printing apparatus includes a reservoir to hold a jetable ink, and a mechanism for diluting an ink concentrate into a jetable ink.

8. An ink suitable for use in an ink jet printing apparatus according to claim 1 wherein said ink is formed by dispersing an ink concentrate with a suitable solvent.

9. An ink according to claim 8 in which the solvent includes water, alcohol, a hydrocarbon fluid, or mineral oil or a combination thereof.

10. An ink according to claim 8 in which said ink includes polymer particles dispersed in a fluid.

11. An ink according to claim 10 in which said ink includes polymer particles having a colorant.

12. An ink according to claim 11 in which said ink colorant includes a pigment, dye, or combination thereof.

13. An ink according to claim 10 in which said ink particles have a mean diameter of 1 micron or less.

14. An apparatus according to claim 1 further including a plurality of modules, each module having an imaging member; an ink jet head capable of image-wise jetting ink onto said imaging member, a mechanism for fractionating such image-wise ink on said imaging member to concentrate such image-wise ink and remove liquid therefrom, an intermediate transfer member onto which such image-wise ink is transferred from said, and a transfer member forming a nip with the intermediate transfer member for transferring a liquid-depleted image-wise ink to a receiver in register with image-wise ink from the remaining plurality of modules.

15. An apparatus according to claim 14 further including separate recycling mechanisms, associated with each module respectively, for returning removed liquid from said respective fractionating mechanism to said respective ink jet head.

16. An apparatus according to claim 15 wherein the ink in each respective module may have different characteristics.

* * * * *